US008523311B2

(12) United States Patent
Satake et al.

(10) Patent No.: US 8,523,311 B2
(45) Date of Patent: Sep. 3, 2013

(54) CAPPING MECHANISM AND SYSTEM FOR IMAGE FORMING APPARATUS

(75) Inventors: Kenichi Satake, Osaka (JP); Masami Ikeda, Osaka (JP); Kikunosuke Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/544,295

(22) Filed: Jul. 9, 2012

(65) Prior Publication Data

US 2012/0274687 A1 Nov. 1, 2012

Related U.S. Application Data

(62) Division of application No. 12/248,210, filed on Oct. 9, 2008, now abandoned.

(30) Foreign Application Priority Data

Oct. 24, 2007 (JP) ..... 2007-276277

(51) Int. Cl.
*B41J 29/13* (2006.01)

(52) U.S. Cl.
USPC ..... 347/16; 347/8

(58) Field of Classification Search
USPC ..... 347/8, 16
See application file for complete search history.

(56) References Cited

U.S. PATENT DOCUMENTS

| | | | | |
|---|---|---|---|---|
| 6,637,958 | B2 | 10/2003 | Smith | 400/354.3 |
| 2002/0159808 | A1 | 10/2002 | Smith | 400/283 |
| 2005/0212883 | A1 * | 9/2005 | Okamoto | 347/104 |
| 2007/0035605 | A1 | 2/2007 | Kitahara | 347/104 |
| 2007/0057990 | A1 * | 3/2007 | Yakura et al. | 347/31 |

FOREIGN PATENT DOCUMENTS

| | | |
|---|---|---|
| EP | 1790487 | 5/2007 |
| JP | 2005-096187 | 4/2005 |
| JP | 2005-199606 | 7/2005 |

* cited by examiner

*Primary Examiner* — Mark Robinson
*Assistant Examiner* — Andrew Jordan
(74) *Attorney, Agent, or Firm* — Frommer Lawrence & Haug LLP

(57) ABSTRACT

The present invention teaches and claims an image forming apparatus comprising: an image forming portion including one or more inkjet heads for forming an image on a recording medium by discharging ink from an ink discharge surface of the inkjet head; a recording medium transporting portion having a transport surface which is positioned below the ink discharge surface and on which the recording medium is placed for transporting a sheet to a position facing the ink discharge surface; a moving mechanism for moving the transport surface toward and away from the ink discharge surface; an ink discharge surface protecting mechanism including but not limited to a cap member and a driving device for moving the cap member; and a control unit for moving the transport surface away from the ink discharge surface to operate the ink discharge surface protecting mechanism when the recording medium is jammed during transportation of the recording medium.

15 Claims, 10 Drawing Sheets

CAPPING MECHANISM AND SYSTEM FOR IMAGE FORMING APPARATUS

INCORPORATION BY REFERENCE

This application is a divisional of application Ser. No. 12/248,210, filed Oct. 9, 2008, which is based upon and claims the benefit of priority from Japanese Patent application No. 2007-276277, filed Oct. 24, 2007, each of which is incorporated by reference herein in its entirety.

FIELD OF THE INVENTION

The present invention claims and discloses an image forming apparatus employing an inkjet system whereby an ink is discharged to a sheet (recording medium) in order to form an image on the sheet.

BACKGROUND OF THE INVENTION

In an image forming apparatus which forms an image on a sheet by discharging ink to the sheet with an inkjet head, a paper jam may occur during transportation of the sheet by a sheet transportation portion. In such an image forming apparatus, an ink discharge surface is provided on a lower surface of the inkjet head. The ink discharge surface has a large number of ink discharging nozzle openings for discharging the ink. The sheet transporting portion (i.e., a paper transport belt) is provided below the ink discharge surface at a small space interval. A user may insert his/her hand or the like in the vicinity of the inkjet head in order to rectify the paper jam occurring in the vicinity of the inkjet head. If a user's hand or the like touches the ink discharge surface of the inkjet head, it is likely to break meniscuses of the ink within the ink discharging nozzles which are open in the ink discharge surface. The meniscus as used herein is a surface on which the ink in the nozzles comes into contact with the open air. The state of the meniscus has an influence on the flying state of the ink. In the case where the meniscus is broken, a satisfactory discharge of the ink cannot be achieved and printing quality is deteriorated. Specifically, the hand or the like comes into contact with the nozzles of the inkjet head resulting in contaminants or the like entering the nozzles, or the ink within the nozzles soiling a hand or the like. In some cases, the meniscuses may be broken or at least damaged.

JP 2005-96187 relates to a conventionally proposed technology of covering the ink discharge surface with a sheet-like shutter in order to prevent, when paper jam occurs, a user from coming into direct contact with the ink discharge surface. For example, the direct contact can occur when a user inserts his/her hand in the vicinity of the inkjet head. With this technology, the user's hand will not be in contact with the ink discharge surface, thereby producing a high-quality image formation on a sheet.

However, in the image fowling apparatus described above, if the sheet remains attached to the ink discharge surface during paper jam, the sheet is caught in the shutter when the shutter moves to a position where the shutter faces the ink discharge surface. Therefore there is a likelihood that the ink discharge surface cannot be protected by the shutter. In such a scenario where the ink discharge surface is not protected, if the user touches the ink discharge surface with a hand, the hand may be stained with the ink. In addition, the meniscuses within the ink discharge nozzles may be broken and/or damaged and lead to the deterioration of printing quality. Moreover, there may be cases where the removal of the paper jam takes a long period of time. For instance, if the ink discharge surface is left unprotected for a period of time, i.e., 30 minutes or more under a state where the air is dry, there is a fear that the ink in the nozzles may dry and the nozzles will be clogged. Alternatively, there is also a fear that the ink in the nozzles will dry, which will cause increased viscosity of the ink and in turn cause defective discharge.

SUMMARY OF THE INVENTION

It is an object of the present invention to provide an image forming apparatus capable of protecting an ink discharge surface even when a sheet is attached to the ink discharge surface.

An image forming apparatus according to one aspect of the present invention comprises: an image forming portion; a recording medium transporting portion; a moving mechanism; an ink discharge surface protecting mechanism; and a control unit. The image forming portion can include an inkjet head having an ink discharge surface for discharging ink. The image forming portion forms an image on a recording medium by discharging ink from the ink discharge surface. The recording medium transporting portion has a transport surface which is arranged below the ink discharge surface while facing the ink discharge surface and on which a recording medium is placed. The recording medium transporting portion transports the recording medium to a position facing the ink discharge surface. The moving mechanism moves the transport surface toward and away from the ink discharge surface. The ink discharge surface protecting mechanism includes a cap member and a driving device. The driving device moves the cap member. The control unit monitors a jam of the recording medium during transportation thereof. When the control unit determines that a jam of the recording medium occurs during the transportation of the recording medium, the control unit moves the transport surface away from the ink discharge surface to activate the ink discharge surface protecting mechanism.

The above and other objects, features, and advantages of the present invention will be more apparent from the following detailed description taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE PREFERRED EMBODIMENTS

Overall Structure

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
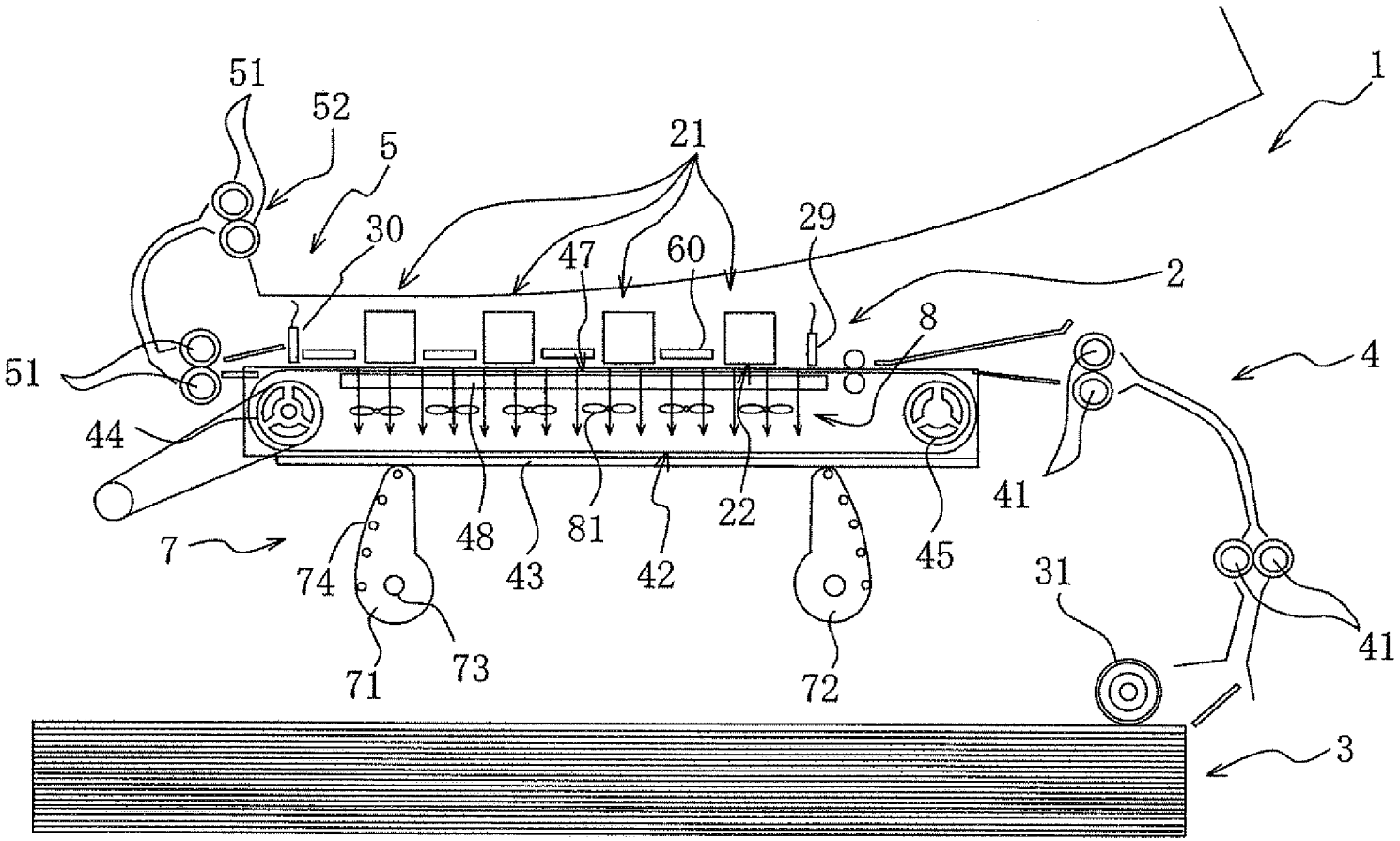
FIG. 1 is a view showing a schematic structure of an image forming apparatus according to one embodiment of the present invention.

Hereinafter, description will be made of various embodiments of the present invention with reference to the accompanying drawings. A schematic structure of an image forming apparatus 1 according to one embodiment of the present invention is shown in FIG. 1. The image forming apparatus 1 is an inkjet printer that is connected to an external computer (not shown). The image forming apparatus 1 is an apparatus for performing an image formation based on image information transmitted from the external computer. The image forming apparatus 1 comprises an image forming portion 2, a sheet accommodating portion 3, a sheet transporting portion 4 serving as a recording medium transporting portion, a moving mechanism 7, an ink discharge surface protecting mechanism 6 (See FIGS. 4 to 6), a sheet holding mechanism 8 serving as a recording medium holding mechanism, a discharging portion 5, and a control unit 9 (See FIG. 7).

The image forming portion 2 is for forming an image based on image data or image information on a sheet as an example of recording medium. The image forming portion includes a plurality of inkjet heads 21. Four of the inkjet heads 21 are arranged above a transport belt 42 of the sheet transporting portion 4 (to be described below) in a direction perpendicular to the sheet transporting direction. The inkjet heads 21 discharge ink on a sheet based on image data or image information. Note that each of the inkjet heads 21 according to one embodiment of the present invention as illustrated in the figures accommodates ink with different colors including an ink discharge surface 22 provided with a plurality of holes (ink discharging nozzles, not shown) for discharging the accommodated ink. The inkjet heads 21 are the so-called "line-type" inkjet heads which form an image by discharging the ink in a width substantially equal to a width perpendicular to the direction of the sheet being transported by the sheet transporting portion 4. In FIG. 1, only one of the ink discharge surfaces is denoted by reference numeral 22 and additional reference numerals 22 are not shown in FIG. 1. The ink discharge surface 22 is provided to a lower surface in each of the inkjet heads 21 and has a long and thin rectangular shape in a front-to-back orientation. The image forming portion 2 causes the ink to be discharged from the ink discharge surface 22. More specifically, the image forming portion 2 causes the ink to be discharged from the holes provided to the ink discharge surface 22, thereby enabling the forming of an image on a sheet. Note that the "front-to-back orientation" mentioned above means an orientation perpendicular to the sheet of FIG. 1, and is synonymous with a longitudinal orientation of the ink discharge surface 22 or a longitudinal orientation of a cap member described below. Particularly, a near side in the direction perpendicular to the page of FIG. 1 is referred to as "front", and a far side is referred to as "back". Further, in the following description, a "left-to-right orientation" means a left-to-right orientation of FIG. 1 and is synonymous with a lateral direction of the ink discharge surface 22.

The sheet accommodating portion 3 is for accommodating one or more sheets on which an image is formed, and arranged in a lower portion of the image forming apparatus 1. The sheet accommodating portion 3 includes a sheet feeding roller 31 for feeding a sheet to the sheet transporting portion 4.

Figure 2:
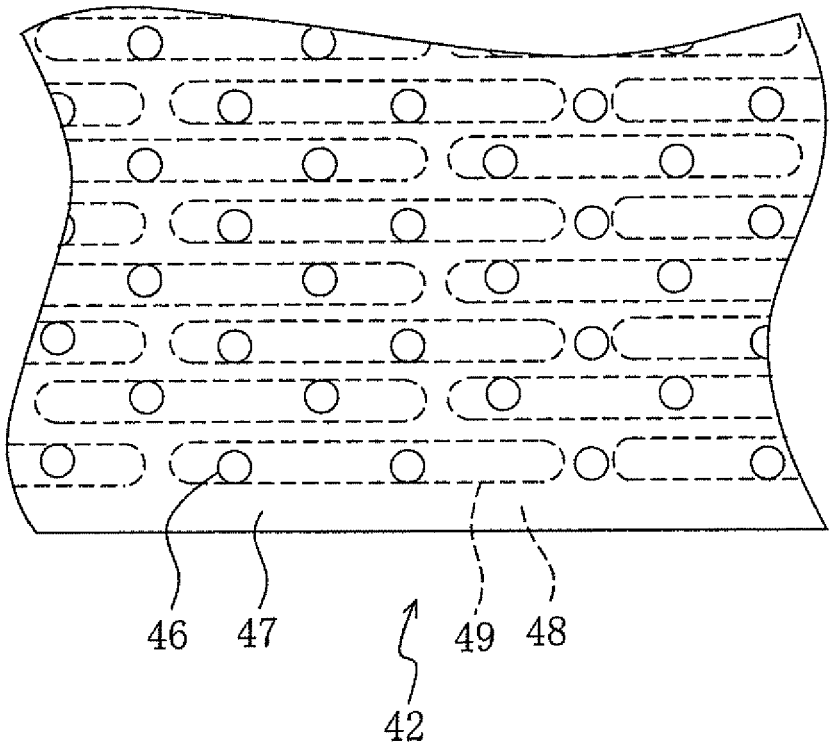
FIG. 2 is an enlarged view of a transport surface according to one embodiment of the present invention.

The sheet transporting portion 4 transports a sheet fed from the sheet accommodating portion 3 to a position facing the image forming portion 2. It then transports the sheet which has a surface on which an image is formed by the image forming portion 2 to the discharging portion 5. The sheet transporting portion 4 includes but is not limited to a plurality of rollers 41 and a transport belt 42 for transporting a sheet. The transport belt 42 which is arranged below the inkjet heads 21 is an endless belt. Rollers 44 and 45 are arranged at the uppermost stream and the lowermost stream of the transport belt 42 for circulating the transport belt 42. The transport belt 42 is supported by a belt supporting member 43 via the rollers 44 and 45. The belt supporting member 43 has a case-like structure similar to a matchbox, and has a top surface serving as a guide plate 48 which is described below. Further, as shown in FIG. 2, the transport belt 42 is provided with a plurality of holes 46 passing therethrough so that air can pass therethrough in a vertical direction. In various embodiments according to the present invention the holes 46 have a diameter of about 4 mm, for example, and are uniformly provided on the transport belt 42 at intervals of about 20 mm. Note that only one of the holes is denoted by reference numeral 46 and additional reference numerals 46 are not shown in FIG. 2.

A top surface of the transport belt 42 is flat and faces the ink discharge surface 22 below the ink discharge surface 22 of the plurality of inkjet heads 21 to become a transport surface 47 on which a sheet is placed so as to face the ink discharge surface 22. Note that in one exemplary embodiment, the distance between the top surface (transport surface 47) of the transport belt 42 and the ink discharge surface 22 is set to about 1 mm. Below the transport surface 47, the guide plate 48 is provided along a transporting direction of a sheet transported on the transport surface 47. As shown in FIG. 2, the guide plate 48 is provided with a plurality of slits 49 passing therethrough. Therefore, when the slits 49 overlap the holes 46 of the transport belt 42, air can pass through the transport belt 42 and the guide plate 48. Note that FIG. 2 is a top view of the transport belt 42 in which the guide plate 48 is arranged overlapping under the transport belt 42 (transport surface 47).

Figure 3:
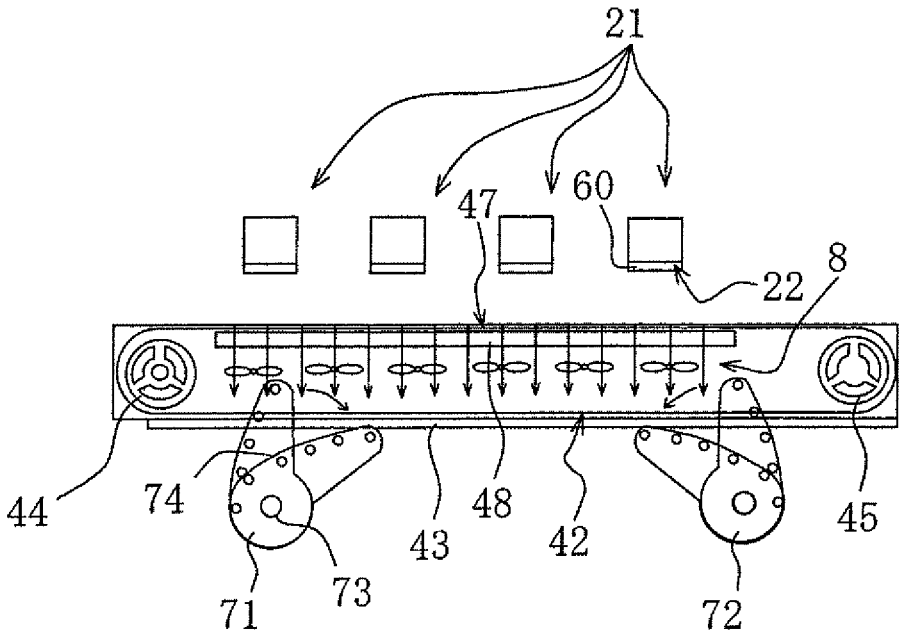
FIG. 3 is a view showing a transport belt in a separate state according to another embodiment of the present invention.

The moving mechanism 7 is a device for moving the transport surface 47 towards or away from the ink discharge surface 22 by moving the transport belt 42 up and down. The moving mechanism 7 which is arranged below the transport belt 42 has a pair of eccentric cams 71 and 72. Of the pair of eccentric cams 71 and 72, the eccentric cam 71 located on the left side of FIG. 1 (hereinafter, referred to as "first eccentric cam 71") is rotatably provided about a shaft portion 73 and is rotatably driven by a motor (not shown). The first eccentric cam 71 is provided with a plurality of bearings 74. The bearings 74 partially protrude from an outer peripheral surface of the first eccentric cam 71. The first eccentric cam 71 supports the belt supporting member 43 via the bearings 74. Note that only one of the bearings is denoted by reference numeral 74 and additional reference numerals 74 are not shown in FIG. 1. Further, the size of the bearings 74, the protruding amount of the bearings 74 from the surface of the first eccentric earn 71, the arrangement of the bearings 74, and the like are positioned such that the belt supporting member 43 is supported only by the bearings 74 when the transport belt 42 is moved in an up and down direction. The constitutions mentioned above are applied to the eccentric cam 72. The eccentric cam 72 is located on the right side of FIG. 1 (hereinafter, referred to as "second eccentric cam 72") and has the same structure as that of the first eccentric cam 71 with a symmetric form with respect to the first eccentric cam 71 in the left-to-right orientation of FIG. 1. FIG. 1 shows a state where the transport belt 42 is moved upward, and from this state, the pair of eccentric cams 71 and 72 rotates inward to move the transport belt 42 down (See FIG. 3). When an image is formed on a sheet by the image forming portion 2, the moving mechanism 7 moves the transport belt 42 upward to a position for forming the image shown in FIG. 1 in order to provide a gap (of about 1 mm in this exemplary embodiment) suitable for printing between a sheet and the ink discharge surface 22 of the inkjet head 21. Further, when the ink discharge surface 22 of the inkjet head 21 is protected with a cap member 60 (described later) in a shutdown state or when the disposal of a paper jam caused on the transport belt 42 is performed, the moving mechanism 7 moves the transport belt 42 down to a waiting position shown in FIG. 3. The effect is to enlarge the gap between the inkjet head 21 and the transport belt 42.

Figure 4:
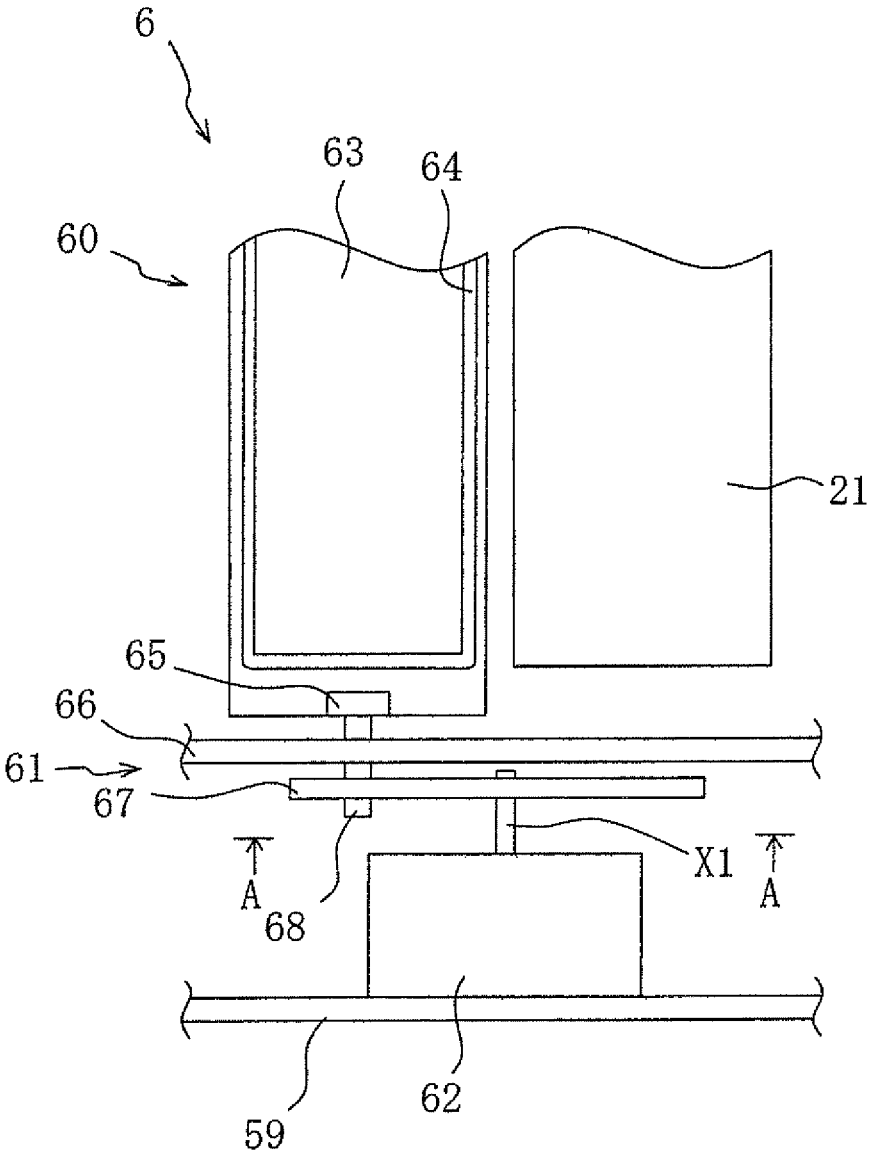
FIG. 4 is a top view showing a structure of an ink discharge surface protecting mechanism according to yet another embodiment of the present invention.
Figure 5:
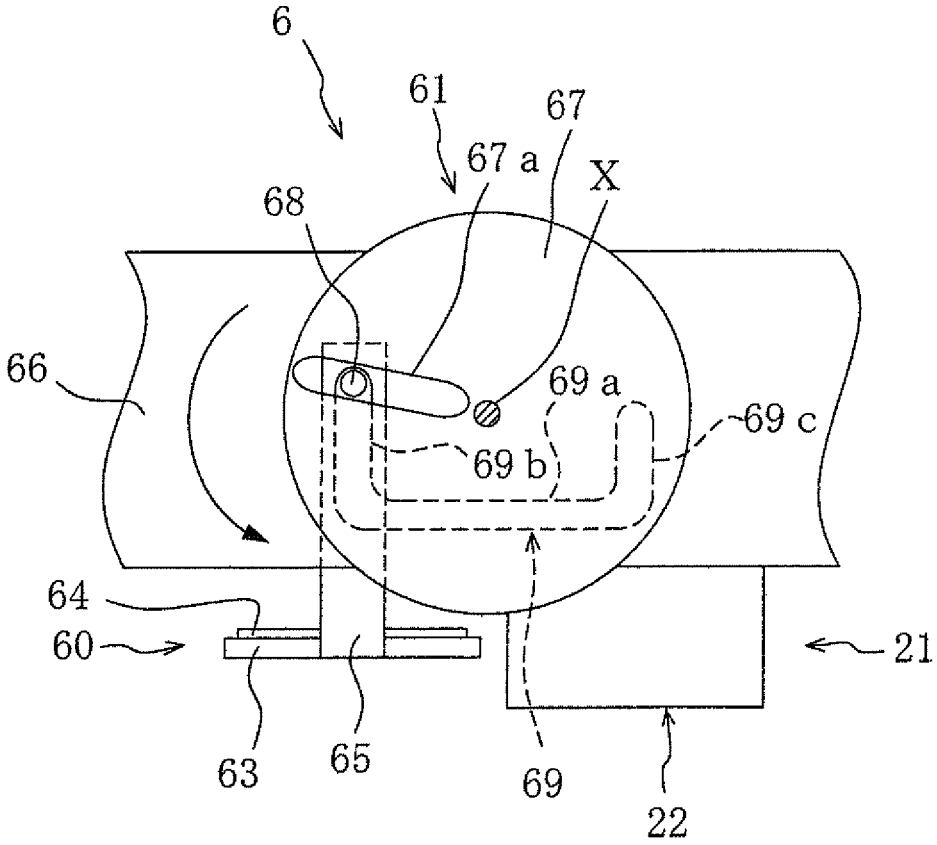
FIG. 5 is a sectional view taken along the line A-A of FIG. 4, showing a cap member at a standby position according to the embodiment shown in FIG. 4 of the present invention.
Figure 6:
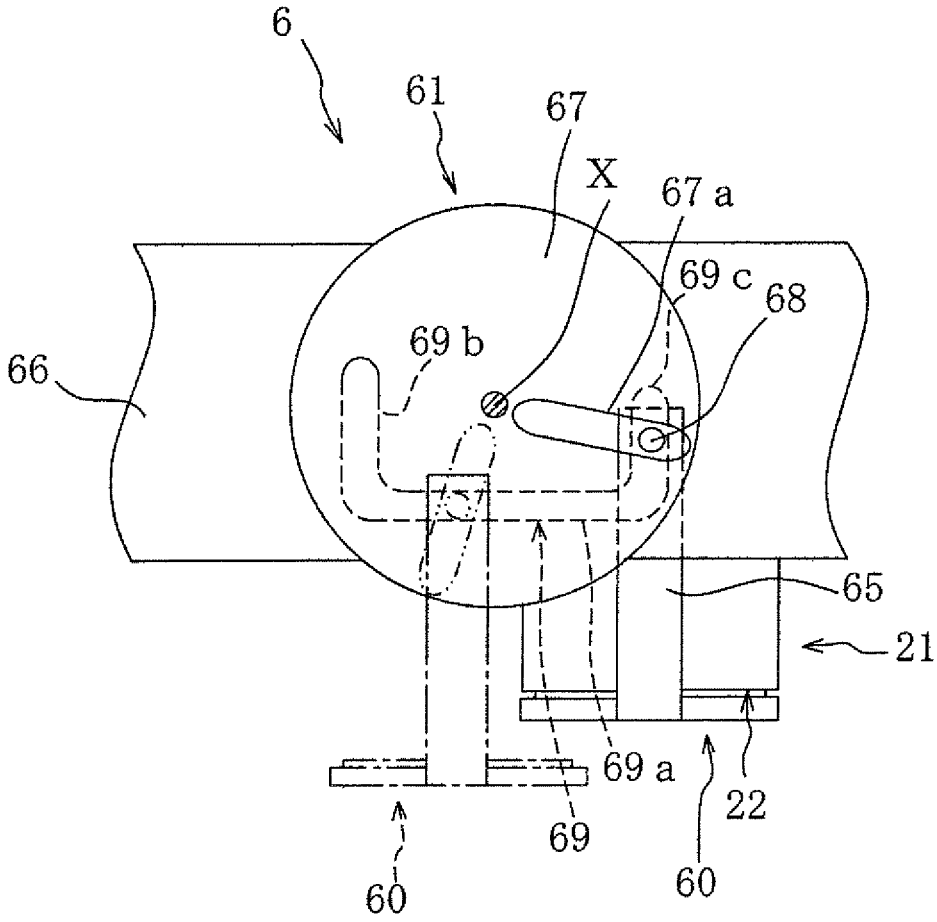
FIG. 6 is a sectional view taken along the line A-A of FIG. 4, showing the cap member at a protecting position according to the embodiment shown in FIG. 4 of the present invention.

The ink discharge surface protecting mechanism 6 includes but is not limited to a cap member 60, a link mechanism 61, and a driving device 62, as shown in FIGS. 4 to 6. Note that FIG. 4 shows a top view of the ink discharge surface protecting mechanism 6, and FIG. 5 and FIG. 6 show sectional views taken along the line A-A of FIG. 4.

The cap member 60 is a member for protecting the ink discharge surface 22 by covering the ink discharge surface 22 of the inkjet head 21. The cap member 60 includes but is not limited to a plate portion 63 and a side wall portion 64. The plate portion 63 has a rectangular shape corresponding to a shape of the ink discharge surface 22, which is made of a metal plate. The side wall portion 64 is uprightly arranged on a surface of the plate portion 63 facing the ink discharge surface 22, that is, a top surface thereof. In other words, the side wall portion 64 is provided along an edge of the top surface of the plate portion 63. The side wall portion 64 is formed of an elastic material such as rubber. The side wall portion 64 is provided over the entire periphery of the plate portion 63 so that the plate portion 63 is not brought into contact with the holes for ink discharge of the ink discharge surface 22. Further, in the case where the ink discharge surface 22 needs to be protected, the side wall portion 64 abuts along an edge of a portion of the ink discharge surface, where the holes for ink discharge are provided. Note that the cap member 60 is constructed so as to shield space surrounded by the ink discharge surface 22 and an inner surface of the cap member 60 from the open air when the cap member 60 abuts on the ink discharge surface 22. The cap member 60 is constructed as described above so that the ink in the holes ultimately deposited on the ink discharge surface 22 does not dry out, even over a period of time as the cap member 60 continues to protect the ink discharge surface 22. The cap member 60 is provided so as to be moved by the link mechanism 61 mentioned below from a predetermined standby position through a position that is lower than the ink discharge surface 22, and thereafter to a position in which the ink discharge surface 22 is covered. More specifically, as further described below in connection with the views shown in FIGS. 5 and 6, in this illustrative embodiment the cap member 60 is configured to be moved from a standby position where the cap member 60 is positioned at a time of image formation to a capping position where the cap member 60 covers the ink discharge surface 22 after being moved through a position lower than the capping position. Note that the standby position of the cap member 60 is a position above the transport belt 42, constituting part of the sheet transporting portion 4 as shown in FIG. 1, and laterally adjacent to the inkjet head 21. In this case, the position lower than the ink discharge surface 22 means a position existing in an ink discharging direction when viewed from the ink discharge surface 22.

The link mechanism 61 can include a cap supporting member 65, a side plate 66, and a driving disk 67.

The cap supporting member 65 supports an end of the cap member 60 in the front-to-back orientation thereof and has a shape extending in a vertical direction (See FIG. 5 and FIG. 6). A lower end of the cap supporting member 65 is connected to the cap member 60. The cap member 60 is perpendicularly attached to the cap supporting member 65. An upper end of the cap supporting member 65 is provided with a shaft member 68, which has a column-like shape extending in the front-to-back orientation. In addition, the shaft member 68 is provided so as to protrude from the cap supporting member 65 to an opposite side of the cap member 60.

The side plate 66 is a guide member for guiding the cap member 60. The side plate 66 is a plate-like member arranged in the front (near side in the direction perpendicular to the page of FIG. 1) of the cup member 60 and the inkjet head 21. The side plate 66 is provided with a slit 69 for guiding the cap member 60. The slit 69 as shown in FIG. 5 can include a horizontal portion 69*a* extending in the left-to-right orientation, a first vertical portion 69*b* connected to an end of the horizontal portion 69*a* and is also vertically extending, and a second vertical portion 69*c* connected to another end of the horizontal portion 69*a* and vertically extending. Note that the side plate 66 is a member constituting part of a housing frame of the image forming apparatus 1.

The driving disk 67 is a driving force transmitting member for transmitting a driving force transmitted from the driving device 62 to the cap member 60 so that the cap member 60 is moved along the slit 69 of the side plate 66. The driving disk 67 is rotatably provided. A rotation center of the driving disk 67 is located between the first vertical portion 69*b* and the second vertical portion 69*c* of the slit 69 of the side plate 66. Besides, the driving disk 67 is provided with a slit 67*a* extending from the rotation center toward a radial direction. The slit 67*a* of the driving disk 67 moves along a trace such that the slit 67*a* and the slit 69 of the side plate 66 are overlapped by the rotation of the driving disk 67. The above-mentioned shaft member 68 of the cap member 60 passes through the slit 69 of the side plate 66 and the slit 67*a* of the driving disk 67, and furthermore, can move along the respective slits 67*a* and 69. Note that, as shown in FIG. 5, in the case where the slit 67*a* of the driving disk 67 overlaps with the first vertical portion 69*b* of the slit 69 of the side plate 66, and the shaft member 68 is located at the first vertical portion 69*b*, the cap member 60 is located at the standby position which is laterally adjacent to the inkjet head 21 and is higher than the ink discharge surface 22. Moreover, as shown in FIG. 6, in the case where the slit 67*a* overlaps with the second vertical portion 69*c* of the slit 69 of the side plate 66 and the shaft member 68 is located at the second vertical portion 69*c*, the cap member 60 is located at a protecting position in which the ink discharge surface 22 is covered. In the case where the slit 67*a* of the driving disk 67 overlaps with the horizontal portion 69*a* of the slit 69 of the side plate 66 and the shaft member 68 is located at the horizontal portion 69*a*, the cap member 60 is located at a position lower than the ink discharge surface 22 (see a cap member 60 indicated by the chain double-dashed line of FIG. 6). Accordingly, as depicted by FIGS. 5 and 6, the cap member 60 is configured to be moved from a standby position (e.g., as shown in FIG. 5) where the cap member 60 is positioned at a time of image formation to a capping position where the cap member 60 covers the ink discharge surface (e.g., as shown by the solid-line cap member 60 in FIG. 6) after being moved through a position lower than the capping position (e.g., as shown by the chain double-dashed line cap member 60 in FIG. 6). Only a front end side of the ink discharge surface protecting mechanism 6 is shown in FIG. 4, but a back end side thereof also has the same structure. Note that, in place of the driving device 62 described later, a bearing (not shown) for rotatably supporting a rotating shaft X1 fixed to the driving disk 67 is arranged.

The driving device 62 shown in FIG. 4 can be a stepping motor for rotating the driving disk 67. The rotating shaft X1 of the driving device 62 is fixed to the center of the driving disk 67. The driving device 62 moves the shaft member 68 by rotating the driving disk 67. The movement of the shaft member 68 can cause the cap member 60 to move. The driving device 62 is fixed to a driving device supporting plate 59 constituting a part of the housing frame of the image forming apparatus 1.

The sheet holding mechanism 8 is for holding a sheet on the transport surface 47. The sheet holding mechanism 8 includes a plurality of blower fans 81 and a motor (not shown) for rotatably driving blower fans 81, as shown in FIG. 1. With the movement of the blower fans 81, an air flow passing through the transport surface 47 and the guide plate 48, that is, a downward air flow passing from an upper side of the transport surface 47 toward a lower side of the guide plate 48, is generated. With this air flow, the sheet holding mechanism 8 can suck the sheet via the transport surface 47 so that the sheet can be held on the transport surface 47. Note that only one of the blower fans is denoted by reference numeral 81 and additional reference numerals 81 are not shown in FIG. 1.

The discharging portion 5 is a portion for discharging a sheet on which an image has been formed by the image forming portion 2. The discharging portion 5 is arranged at an upper portion of the image forming apparatus 1. The discharging portion 5 includes but is not limited to at least one roller and preferably a plurality of rollers 51. The sheet on which an image has been formed by the image forming portion 2 is transported by the transport belt 42 and the rollers 51 and is discharged outside the apparatus from an outlet 52.

Figure 7:
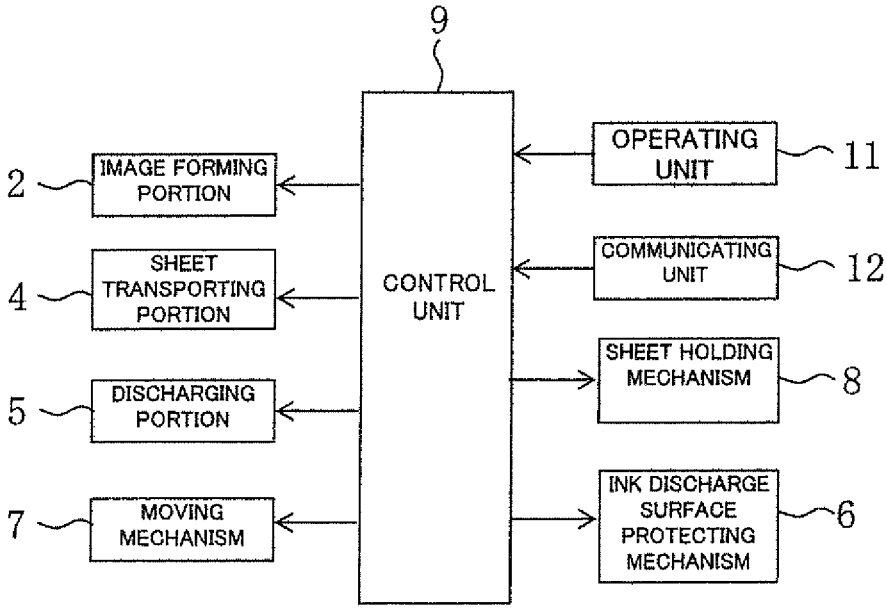
FIG. 7 is a control block diagram of the image forming apparatus according to still another embodiment of the present invention.

As shown in FIG. 7, the control unit 9 performs various processing including but not limited to image formation by controlling the image forming portion 2, the sheet transporting portion 4, the discharging portion 5, the moving mechanism 7, the sheet holding mechanism 8, the ink discharge surface protecting mechanism 6, and the like, according to inputs from an operating unit 11 which is operated by a user and a communicating unit 12 for communicating with an external computer (not shown). Furthermore, the control unit 9 is connected to a first sheet detecting sensor 29 which serves as a first recording medium detecting member and a second sheet detecting sensor 30 which serves as a second recording medium detecting member which are described below. The detecting sensors monitor whether or not a sheet can cause a paper jam during the time when the sheet is transported by sheet transporting portion 4.

Control of Image Forming Apparatus

Figure 8:
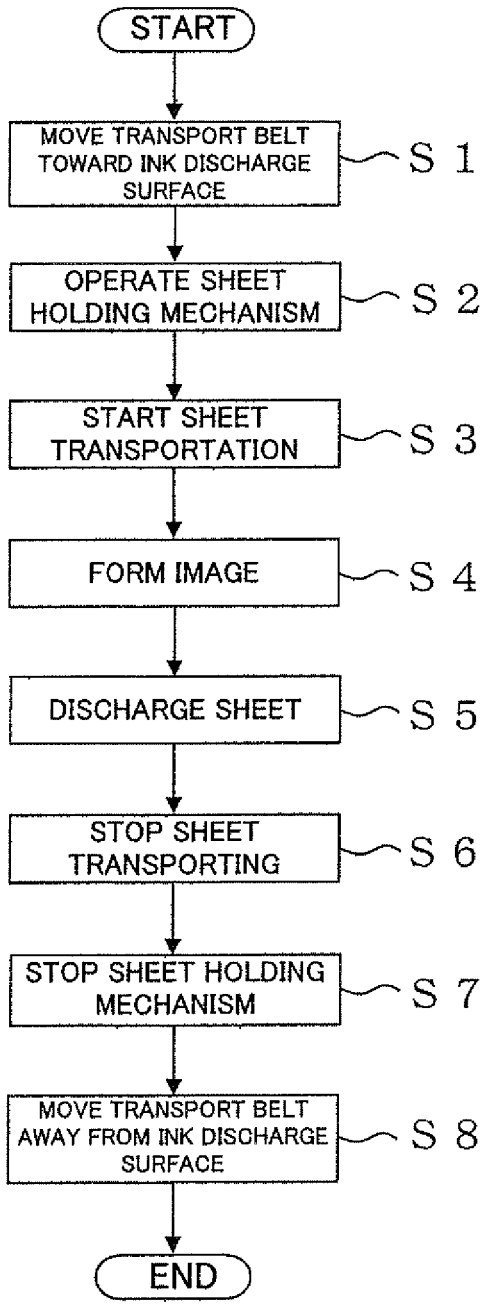
FIG. 8 is a flow chart showing a control flow in a normal image formation according to a further embodiment of the present invention.

Hereinafter, the control of the image forming apparatus 1 performed by the control unit 9 is described. First, a control flow at a normal image formation is described with reference to FIG. 8.

In the first step S1, the transport belt 42 is moved. In this case, the moving mechanism 7 operates to move the transport belt 42, which stands by at the waiting position and away from the ink discharge surface 22, to the position for forming the image. This position is where the transport belt 42 comes close to the ink discharge surface 22 (See FIG. 1).

In the second step S2, the sheet holding mechanism 8 operates. Note that other embodiments of the present invention allow the second step S2 and the first step S1 to be inversely performed or simultaneously performed.

After operation of the sheet holding mechanism 8, the sheet transporting portion 4 operates to start transporting a sheet in step S3.

In the fourth step S4, the ink is discharged from the ink discharge surface 22 to form an image on the sheet. Ink discharge starts after a specific time has elapsed after the leading end of the sheet is detected by the first sheet detecting sensor 29. The first sheet detecting sensor 29 is typically installed upstream of the inkjet head 21 in the uppermost stream of a path where the sheet is transported. The specific starting time is set longer for the inkjet heads 21 located more downstream. Therefore the discharge of the ink is sequentially started from the inkjet heads 21 located upstream of a sheet transporting direction to form an image on the sheet which is transported below the inkjet heads 21. Then, in the fifth step S5, the sheet on which the image has been formed is discharged outside the apparatus.

After the image formation onto the sheet is completed, the sheet transporting portion 4 is stopped in the sixth step S6 and the sheet holding mechanism 8 is stopped in the seventh step S7.

In the eighth step S8, the transport belt 42 is moved. In this step, the moving mechanism 7 operates to move the transport belt 42 from the position for forming an image where the transport belt 42 comes close to the ink discharge surface 22 to the waiting position (See FIG. 3) where the transport belt 42 is away from the ink discharge surface 22.

Figure 9:
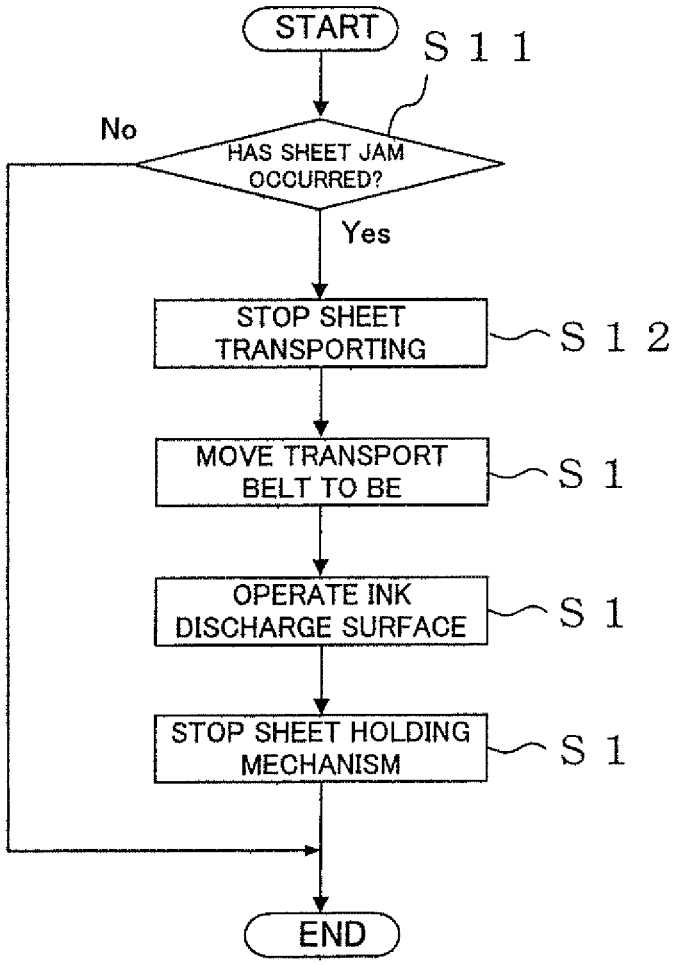
FIG. 9 is a flow chart showing a control flow in an occurrence of a paper jam according to still a further embodiment of the present invention.

Next, how to use a control flow to remedy a paper jam is described with reference to FIG. 9.

Initially the occurrence of the paper jam is detected in the eleventh step S11. Step S11 is performed during the image formation operation in the fourth step 54. The sheet transporting portion 4 is stopped in the twelfth step S12. Note that the occurrence of the paper jam is detected as follows. In this exemplary case in accordance with the present invention, the second sheet detecting sensor 30 is arranged immediately upstream of the rollers 51 which are arranged downstream of the transport belt 42. That is, rollers 51 are located immediately downstream of the inkjet heads 21 which are located in the lowermost stream. In other words, in the case where a specific time (time A) has elapsed after the leading end of the sheet is detected by the first sheet detecting sensor 29, and further when the leading end of the sheet cannot be detected by the second sheet detecting sensor 30, the control unit 9 determines that the paper jam has occurred in the transporting path in the vicinity of the transport belt 42. Alternatively, in the case where a specific time (time B) has elapsed after the leading end of the sheet is detected by the first sheet detecting sensor 29, and further when a trailing end of the sheet cannot be detected by the second sheet detecting sensor 30, it can be determined that the leading end of the sheet has passed through a position opposite to the second sheet detecting sensor 30. It can then also be determined that the paper jam has occurred on the transporting path before the trailing end of the sheet reaches the position opposite to the second sheet detecting sensor 30. Accordingly, the control unit 9 determines that the paper jam is being caused on the transporting path in the vicinity of the transport belt 42. Note that in various other embodiments the two determinations described above for the paper jam may be combined.

In the thirteenth step S13, the transport belt 42 is moved. In this case, the moving mechanism 7 operates to move the transport belt 42 from the position for forming an image where the transport belt 42 comes close to the ink discharge surface 22 to the waiting position where the transport belt 42 is away from the ink discharge surface 22. After the occurrence of the paper jam is detected and while the transport belt 42 is being moved, the sheet holding mechanism 8 is in an operating state. In this state an attraction force acting on the sheet for holding the sheet on the transport surface 47 is maintained. For that reason, in the case where the sheet is attached to the ink discharge surface 22, the sheet can be separated from the ink discharge surface 22 by the attraction force due to the sheet holding mechanism 8 and a moving force of the transport belt 42. Alternatively, the sheet which caused the paper jam can be positioned or moved so that it is difficult for the sheet to be attached to the ink discharge surface 22.

Figure 10A:
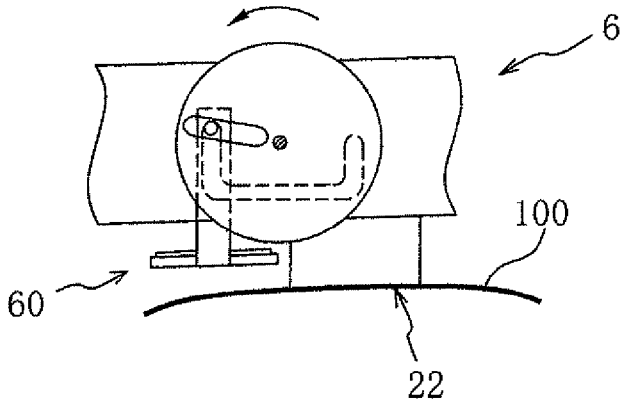
FIG. 10A, FIG. 10B, and FIG. 10C are views showing an operation of the ink discharge surface protecting mechanism according to yet still a further embodiment of the present invention.
Figure 10B:
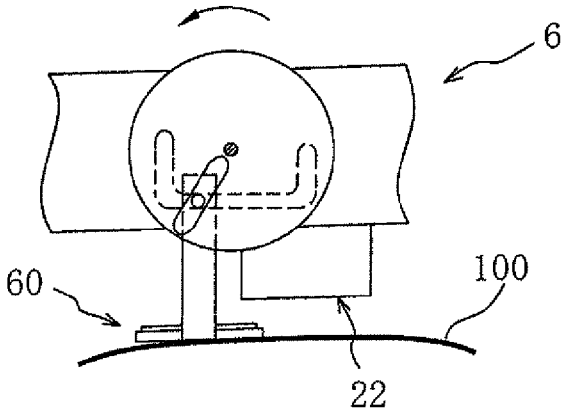
Figure 10C:
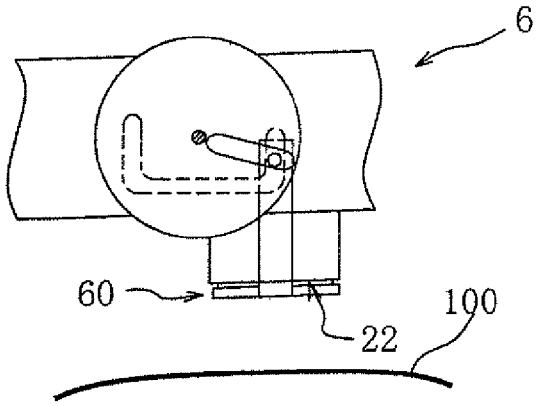

When the transport belt 42 is moved in the thirteenth step S13 and the distance between the ink discharge surface 22 and the transport surface 47 is expanded, then the ink discharge surface protecting mechanism 6 operates in the fourteenth step S14. In this case, the cap member 60 is moved from the standby position (See FIG. 10A) to the protecting position (See FIG. 10C), whereby the ink discharge surface 22 is protected by the cap member 60. During this transition, the cap member 60 passes through a lower position than the ink discharge surface 22 when moving from the standby position to the protecting position. Therefore, in the case where a sheet 100 cannot be taken off from the ink discharge surface 22 even by the operation of the sheet holding mechanism 8, the sheet 100 is separated from the ink discharge surface 22 by a force generated when the cap member 60 is intended to move to the lower position than the ink discharge surface 22 (See FIG. 10B). In particular, the cap member 60 comes close to the ink discharge surface 22 while horizontally moving in the lower position than the ink discharge surface 22. This movement causes the sheet 100 attached to the ink discharge surface 22 to be reliably separated. Therefore, even in the case where the sheet 100 cannot be separated from the ink discharge surface 22 in the thirteenth step S13, as described above, the sheet 100 can be reliably separated from the ink discharge surface 22 in the fourteenth step S14. Further, after the sheet 100 is separated from the ink discharge surface 22, the ink discharge surface 22 can be protected with the cap member 60 (See FIG. 10C). When a user removes the sheet 100 that caused the paper jam, it is possible to prevent the hand or the like of the user from unintentionally coming in contact with the ink discharge surface 22. As a result, defective images are prevented from being generated in a subsequent image formation.

After the transport belt 42 is located at the waiting position by the moving mechanism 7, the sheet holding mechanism 8 is stopped in the fifteenth step S15 for safety purposes in order to facilitate the sheet removal from the transport belt 42 by the user.

In the image forming apparatus 1, the sheet can be easily separated from the ink discharge surface 22 even when the sheet is attached to the ink discharge surface 22. Further, after the sheet is separated from the ink discharge surface 22, the ink discharge surface 22 can be covered with the cap member 60 for protection.

Other Embodiments In Accordance of the Present Invention

In another embodiment of the present invention, when the occurrence of the paper jam is detected in the eleventh step S11, the operation of the sheet holding mechanism 8 may be caused to be stopped in order to separate the sheet from the ink discharge surface 22 only, by the movement of the cap member 60 in the fourteenth step S14.

In the above-mentioned embodiments, the air flow headed from a sheet side of the transport surface 47 to an opposed side thereof is generated to suck the sheet, whereby the force for holding the sheet on the transport surface 47 is generated. However, in yet another embodiment of the present invention, a different mechanism from the above, for example, may be used employing an electrostatic attraction force for holding the sheet on the transport surface 47.

In the above-mentioned various embodiments, after the transport surface 47 is separated from the ink discharge surface 22 (thirteenth step S13), the cap member 60 is moved to the protecting position (fourteenth step S14). However, the transport surface 47 is not moved to the waiting position in the thirteenth step S13, but in various other embodiments of the present invention the transport surface 47 may be slightly moved so as to ensure a gap into which the cap member 60 can be inserted. The cap member 60 may also be moved to the protecting position, and then the transport surface 47 may be moved again to the waiting position while a state in which the sheet holding mechanism 8 is in operation. Accordingly, the sheet attached to the ink discharge surface 22 can be more reliably separated from the ink discharge surface 22.

In the above-mentioned embodiments, a color printer is exemplified as the image forming apparatus 1. However, the present invention is not limited thereto, and may be applied to a multi-function peripheral having functions such as a copying machine, a facsimile machine, or a device only having a copy function. Further, the present invention is not limited to a device which can form a color image, and may be applied to an image processing apparatus capable of forming only a monochrome image.

In the above-mentioned embodiments, the moving mechanism 7 and the ink discharge surface protecting mechanism 6 are operated by the control unit 9. In other embodiments of the present invention, a front door (not shown) may be provided on the front surface side of the image fowling apparatus 1. Preferably the front door can be locked while the moving mechanism 7 and the ink discharge surface protecting mechanism 6 operate and can be opened by the user to check the inside thereof for the disposal of the paper jam or the like while the moving mechanism 7 and the ink discharge surface protecting mechanism 6 don't operate. With this, it is possible to prevent the hand or the like of the user from being caught in the moving mechanism 7 and the ink discharge surface protecting mechanism 6 under operation when the user abruptly opens the front door to insert the hand into the image forming apparatus 1. Further, it is possible to prevent the user's hand from coming into direct contact with the ink discharge surface 22 of the inkjet head 21 which is not protected by the cap member 60.

According to the above-mentioned embodiments of the present invention, after the operations of the moving mechanism 7 and the ink discharge surface protecting mechanism 6 by the control unit 9 are completed, a display indicating that the paper jam has occurred may be made on a display portion (not shown) in the image forming apparatus 1. Alternatively in other embodiments of the present invention, after the operations of the moving mechanism 7 and the ink discharge surface protecting mechanism 6 by the control unit 9 are completed, a display indicating that the paper jam has occurred may be made on a display screen of a connected computer that ordered printing for the sheet which has caused the paper jam. Then, after the operations of the moving mechanism 7 and the ink discharge surface protecting mechanism 6 are completed, the user is informed of the occurrence of the paper jam. Therefore, the user can safely perform the disposal of the paper jam, and further, the user can be prevented from touching by the hand the ink discharge surface 22 of the inkjet head 21 which is not protected by the cap member 60.

What is claimed is:

1. An image forming apparatus comprising:

an image forming portion comprising one or more inkjet heads, each with an ink discharge surface configured to discharge ink to form an image on a recording medium by discharging the ink from the one or more ink discharge surfaces;

a recording medium transporting portion including a transport surface which is configured to receive and transport a recording medium and cause the recording medium to face the one or more ink discharge surfaces;

a moving mechanism configured to move the transport surface toward and away from the ink discharge surface;

a control unit configured (i) to monitor the transportation of the recording medium, and (ii) to move the transport surface away from the ink discharge surface after determining that the recording medium is jammed;

a recording medium holding mechanism configured to hold the recording medium on the transport surface; and one or more ink discharge surface protecting mechanisms having a cap member;

a driving portion configured to move the cap member, a guide member provided with a slit configured to guide the cap member; and a driving force transmitting member configured to transmit a driving force transmitted from the driving portion to the cap member so that the cap member moves along the slit of the guide member, wherein the control unit is configured such that in the event that the control unit determines that the recording medium is jammed, the control unit continues an operation of the recording medium holding mechanism; and wherein the cap member is configured to be moved by the driving portion from a standby position where the cap member is positioned at a time of image formation to a capping position where the cap member covers the ink discharge surface after being moved through a position lower than the capping position.

2. The image forming apparatus according to claim 1, wherein the recording medium holding mechanism is configured to generate an attraction force acting on the recording medium for holding the recording medium on the transport surface; and wherein the control unit is configured such that in the event that the control unit determines that the recording medium is jammed, the control unit maintains the attraction force.

3. The image forming apparatus according to claim 2, wherein the moving mechanism is configured to move the transport surface away from the ink discharge surface after the control unit determines that the recording medium is jammed; and wherein when the recording medium is attached to the one or more ink discharge surface, via the attraction force and a moving force generated from moving of the transport surface, the recording medium is configured to be separated from the one or more ink discharge surface.

4. The image forming apparatus according to claim 1, wherein the recording medium holding mechanism includes at least one blower fan and a motor configured to rotatably drive the at least one blower fan and is configured to suck the recording medium via the transport surface.

5. The image forming apparatus according to claim 1, wherein the moving mechanism is configured to move the transport surface away from the ink discharge surface to a waiting position after the control unit determines that the recording medium is jammed; and wherein the control unit is configured such that in the event that the moving mechanism moves the transport surface to the waiting position, the control unit stops the operation of the recording medium holding mechanism.

6. The image forming apparatus according to claim 1, further comprising:

a first recording medium detecting member which is provided upstream of the image forming portion in a recording medium transporting direction of the recording medium transporting portion; and a second recording medium detecting member which is provided downstream of the image forming portion in the recording medium transporting direction of the recording medium transporting portion.

7. The image forming apparatus according to claim 6, wherein the control unit is configured to determine that the recording medium is jammed when a predetermined time has elapsed after a leading end of the recording medium is detected by the first recording medium detecting member, and the second recording medium detecting member does not detect the leading end of the recording medium.

8. The image forming apparatus according to claim 6, wherein the control unit is configured to determine that the recording medium is jammed when a predetermined time has elapsed after a leading end of the recording medium is detected by the first recording medium detecting member, and the second recording medium detecting member does not detect a trailing end of the recording medium.

9. The image forming apparatus according to claim 1, wherein the standby position is above the recording medium transporting portion and is laterally adjacent to the inkjet head.

10. The image forming apparatus according to claim 1, wherein the cap member is configured to move below a recording medium transporting path determined by the recording medium transporting portion.

11. The image forming apparatus according to claim 1, wherein in the event that the control unit determines that the recording medium is jammed and the recording medium is attached to the ink discharge surface, the cap member is configured to be moved from the standby position to the capping position through the position lower than the capping position and a movement of the cap member moving through the position lower than the capping position causes a downward force to the recording medium attached to the ink discharge surface to be separated.

12. The image forming apparatus according to claim 1, wherein the slit of the guide member includes a first slit portion which extends in a substantially vertical direction;

a second slit portion which extends in a substantially horizontal direction; and a third slit portion which extends in the substantially vertical direction;

wherein, when the cap member moves from the standby position to the position lower than the capping position, the cap member moves along the first slit portion;

wherein, when the cap member is in the the position lower than the capping position, the cap member moves along the second slit portion; and wherein, when the cap member moves from the position lower than the capping position to the capping position, the cap member moves along the third slit portion.

13. A method of protecting one or more ink discharge surfaces of inkjet heads in an image forming apparatus where a jam is detected during a printing operation, comprising:

moving a transport belt toward the one or more ink discharge surfaces;

discharging ink from the one or more ink discharge surfaces to form an image on a recording medium carried by the transport belt; and determining whether a jam of the recording medium has occurred, and if so, (i) moving the transport belt away from the one or more ink discharge surfaces of the inkjet heads while holding the recording medium on the surface of the transport belt during transportation of the recording medium toward the one or more ink discharge surfaces; and (ii) moving a cap member from a standby position where the cap member is positioned at a time of image formation to a capping position where the cap member covers the one or more ink discharge surfaces after being moved through a position lower than the capping position.

14. The method according to claim 13, wherein the moving the transport belt includes moving the transport belt to a waiting position; and the method further comprising: after the moving the transport belt to the waiting position, stopping the holding of the recording medium.

15. The method according to claim 13, further comprising: depressing the recording medium on the surface of the transport belt during transportation of the recording medium toward the ink discharge surfaces.

* * * * *